US011019868B2

(12) United States Patent
Shoulders

(10) Patent No.: US 11,019,868 B2
(45) Date of Patent: Jun. 1, 2021

(54) HELMET BRIM MOUNT WITH MULTI-AXIS PIVOT

(71) Applicant: Bayco Products, Inc., Wylie, TX (US)

(72) Inventor: Aaron Paul Shoulders, Sachse, TX (US)

(73) Assignee: Bayco Products, Inc., Wylie, TX (US)

( * ) Notice: Subject to any disclaimer, the term of this patent is extended or adjusted under 35 U.S.C. 154(b) by 168 days.

(21) Appl. No.: 16/540,491

(22) Filed: Aug. 14, 2019

(65) Prior Publication Data

US 2021/0045485 A1 Feb. 18, 2021

(51) Int. Cl.

| | |
|---|---|
| ***F21V 21/00*** | (2006.01) |
| ***A42B 1/244*** | (2021.01) |
| ***F21V 21/30*** | (2006.01) |
| ***F21V 21/088*** | (2006.01) |
| ***F21V 21/084*** | (2006.01) |
| ***A42B 1/24*** | (2021.01) |

(52) U.S. Cl.

CPC ..... *A42B 1/244* (2013.01); *F21V 21/0885* (2013.01); *F21V 21/30* (2013.01); *A42B 1/24* (2013.01); *F21V 21/084* (2013.01); *F21V 21/088* (2013.01)

(58) Field of Classification Search

CPC .... F21V 21/0885; F21V 21/30; F21V 21/084; F21V 21/088; A42B 1/244; A42B 1/24

USPC ..... 362/105, 106, 427, 396; 2/10

See application file for complete search history.

(56) References Cited

U.S. PATENT DOCUMENTS

| | | | | |
|---|---|---|---|---|
| 4,516,192 | A * | 5/1985 | Bolwig | F21L 15/14 362/107 |
| 6,467,929 | B2 * | 10/2002 | Lee | A42B 1/242 362/190 |
| 6,619,813 | B1 * | 9/2003 | Schnell | A44B 15/005 362/116 |
| 6,764,194 | B1 * | 7/2004 | Cooper | F21V 21/084 362/103 |
| 7,168,821 | B2 * | 1/2007 | Huang | G02C 11/04 24/3.1 |
| 8,545,041 | B2 * | 10/2013 | Brown | F21V 21/0885 362/191 |
| 9,033,540 | B1 * | 5/2015 | McCorkle | F21V 21/0885 362/191 |
| 9,039,228 | B1 * | 5/2015 | McCorkle | F21V 21/0885 362/191 |
| 2005/0254238 | A1 * | 11/2005 | Parker | F21V 21/0885 362/191 |
| 2010/0180364 | A1 * | 7/2010 | Willey | A42B 3/042 2/422 |
| 2012/0099333 | A1 * | 4/2012 | Wang | F21V 21/0885 362/396 |
| 2012/0236543 | A1 * | 9/2012 | Torgerson | F21V 21/0885 362/106 |
| 2018/0195676 | A1 * | 7/2018 | Sharrah | F21V 23/0414 |

* cited by examiner

*Primary Examiner* — Laura K Tso

(74) *Attorney, Agent, or Firm* — Whitaker Chalk Swindle & Schwartz PLLC; Stephen S. Mosher

(57) ABSTRACT

An articulated brim mount for a helmet light that mounts on the brim of a hat or worker's helmet enables pivoting of the helmet light through angles of up to 210 degrees in a vertical plane and at least 360 degrees in a horizontal plane. The pivots are configured to provide controlled friction so that the angles of the light can be adjusted by hand without tools while retaining the position set by the user.

11 Claims, 4 Drawing Sheets

HELMET BRIM MOUNT WITH MULTI-AXIS PIVOT

BACKGROUND OF THE INVENTION

1. Field of the Invention

The present invention relates to flashlight apparatus and more particularly to apparatus for supporting a flashlight on a brim of a helmet or similar edge that enables orientation of the flashlight in various directions without the use of tools.

2. Background of the Invention

Mounting apparatus for supporting a lamp or flashlight on a helmet or hat are well-known in the art. Such apparatus may include a harness or headband, a holster or pocket attached to the hat or helmet, and the like. Other devices may include a clamp to secure the lamp or flashlight to the helmet or hat that requires tools to fasten the device to the helmet or hat. Typically the aforementioned apparatus lacks the capability to adjust the orientation of the lamp or light without tools or an inconvenient trial-and-error process. What is needed is a mounting device that can be installed and adjusted without the use of tools and also allows full and convenient adjustment of the orientation of the light beam in any angle.

SUMMARY OF THE INVENTION

Accordingly an apparatus is disclosed for supporting a light on a helmet brim that comprises a U-shaped clamp body formed as a vise for securing to the helmet brim, wherein a flattened pivot arm having a first bushing aperture extends opposite an open end of the U-shaped clamp body; a support member having first and second ends, the first end configured with a second bushing aperture and the second end configured with a circumferential flange having a diameter to be received in an internally threaded docking well formed in a housing of the light; a binding barrel assembly disposed through the first and second bushing apertures to form a first pivot and enable the support member to pivot in a first plane through at least 180 degrees about the first pivot; and an externally threaded retainer disposed around the support member adjacent the circumferential flange to secure the support member into the docking well thereby forming a second pivot to enable the light housing to pivot 360 degrees in a second plane orthogonal to the first plane.

In one aspect, the U-shaped clamp body comprises a first prong of the open end of the U-shaped clamp body configured as a fixed jaw of a clamp; a second prong of the open end of the U-shaped clamp body configured with a bolt threaded there through; and a movable foot attached to a threaded end of the bolt and disposed opposite the fixed jaw, to enable securing the U-shaped clamp body on the helmet brim.

In another aspect, the binding barrel pivot assembly comprises a sleeve nut configured as a pivot shaft that forms the first pivot when joined with the first and second bushing apertures; first and second outside washers, one on either side of the tab extending from the support pedestal; a wear washer disposed next to either first or second outside washer; and a binding screw threaded into the sleeve nut for securing the binding barrel pivot assembly.

In another aspect, the binding retainer comprises a retaining ring having an external thread for mating with internal threads formed in the docking well of the housing to secure the circumferential flange of the support member in the docking well of the light housing.

DETAILED DESCRIPTION OF THE INVENTION

Figure 1:
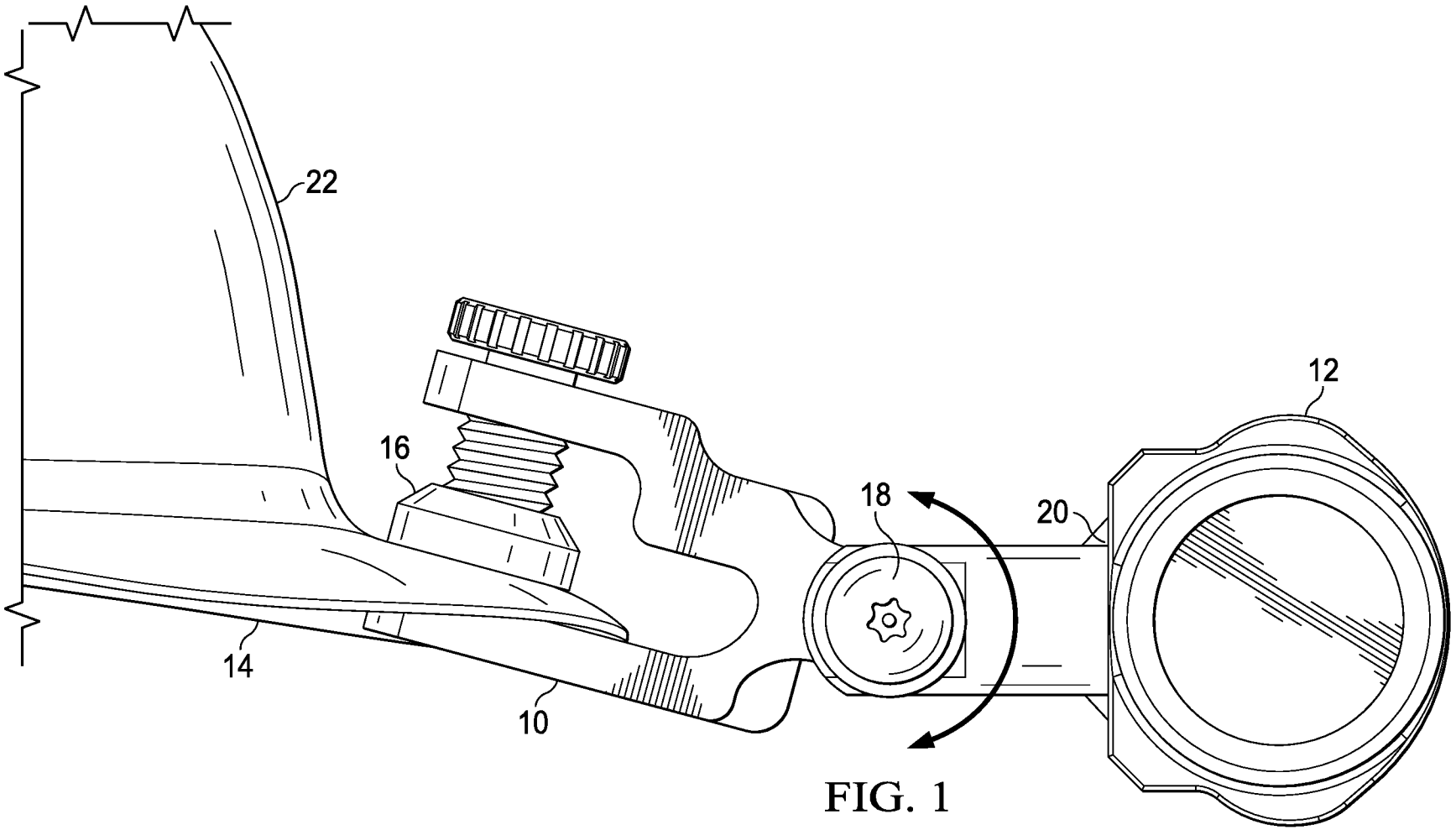
FIG. 1 illustrates a brim mount for a flashlight, oriented in a first position, in accordance with one embodiment of the claimed invention.

In an advance in the state of the art, an articulated brim mount or mounting fixture for a helmet light that enables adjustably pivoting of the mounted light through angles of up to 210 degrees in a first plane and at least 360 degrees in a second, orthogonal plane. The brim mount mounts on the brim of a hat such as a worker's helmet. A first pivot is configured with a binding barrel design that applies sufficient friction to adjust and hold the mounted light in a set position by hand while enabling the mounted light to pivot through 210 degrees in the first plane without the use of tools. A second pivot, configured with a binding retainer design that applies sufficient friction to adjust and hold the mounted light in a set position by hand while enabling the mounted light to pivot through 360 degrees in the second plane without the use of tools. The brim mount includes a form of a clevis that is configured as a clamp or vise having a fixed jaw and a movable jaw or foot coupled to an adjustment bolt in one prong of the clamp for securing the brim mount and its attached helmet light to the brim of the helmet, again without the use of tools. The brim mount allows the user to adjust the orientation of the mounted light while the light is mounted on the helmet because of the controlled amount of friction engineered into the first and second pivots.

The clevis form, as is well-known, is generally a U-shaped member having first and second legs or prongs joined to a cross member forming a closed end. In the illustrated embodiment, an adjustable vise is formed by a first leg that includes a fixed jaw disposed in the open end of the U-shape near the distal end of the first leg. The fixed jaw may be one leg of the vise that includes a foot or pad as a fixed jaw. The second leg of the adjustable vise may include a bolt disposed in a threaded hole through the distal end of the second leg and aligned on an axis opposite the fixed jaw. The bolt may include a movable jaw disposed on the end of the bolt in juxtaposition relative to the fixed jaw. On installation of the brim mount, the brim is placed between the fixed and movable jaws and the bolt tightened to secure the brim mount on the brim of the helmet. The bolt may have a head formed as a knurled knob or similar handle that is easy to turn by hand.

The clevis form of the clamp body may also include a flattened pivot arm extending from the closed end of the clevis and away from the adjustable jaw and the brim of the helmet upon which the brim mount is installed. The distal end of the pivot arm preferably includes a first bushing aperture to form a first adjustable pivot with a binding barrel assembly that pivotably supports a cylindrical support member, enabling the support member to pivot through an angle of at least 210 degrees in a first plane. The support member includes first and second ends and a second bushing aperture at its first end for receiving a sleeve nut of the binding barrel assembly therein. The binding barrel assembly permits the rotation of the support member by hand but applies enough friction to maintain the support member at a selected angular position set by a user. The binding barrel assembly may include the sleeve nut and an adjusting screw having the same thread as the sleeve nut, an inside and an outside washer, and a wear washer. The sleeve nut and the adjusting screw may have a "Torx" or other secure configuration for aid in tightening the binding barrel assembly. The threads of the adjusting screw may be coated with a thread locking adhesive such as "Thread Locker," a product of the Loc-Tite® Corporation, to secure the threaded fastener from turning after the screw is turned to apply the desired amount of tension against the support pedestal.

The second end of the support member is preferably formed with a circumferential flange or base. The circumferential flange may preferably have a diameter approximately ⅛ inch greater (in the illustrated embodiment) than the diameter of the support member. The circumferential flange should be sized to fit within an internally threaded docking well formed in the housing of the lighting device, such as a flashlight, to be supported by the brim mount disclosed herein. After the base or circumferential flange at the second end of the support member is seated into the docking well of the light housing, a wear washer and a retaining nut (externally threaded) or "retainer" may be screwed into the docking well over the support member to secure it against the circumferential flange and the support member to the bottom of the docking well of the light housing. The nut may be tightened to provide the required friction between the second end of the support member and the bottom of the docking well to allow it to be rotated through an angle of 360 degrees in the second plane to the orientation desired by the user. In the illustrated embodiment, the second plane is preferably orthogonal to the first plane.

Figure 2:
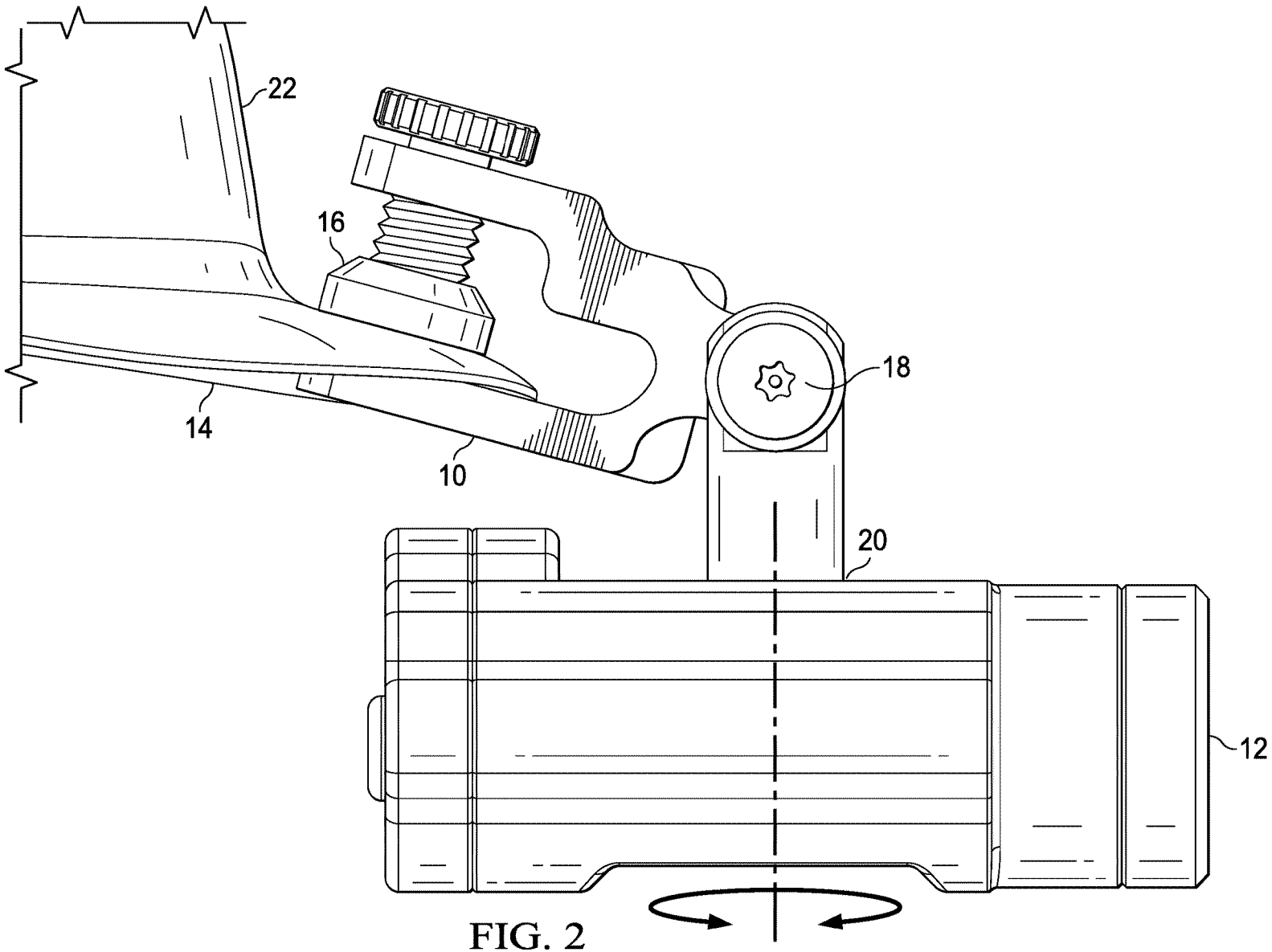
FIG. 2 illustrates the brim mount of FIG. 1, oriented in a second position.
Figure 3:
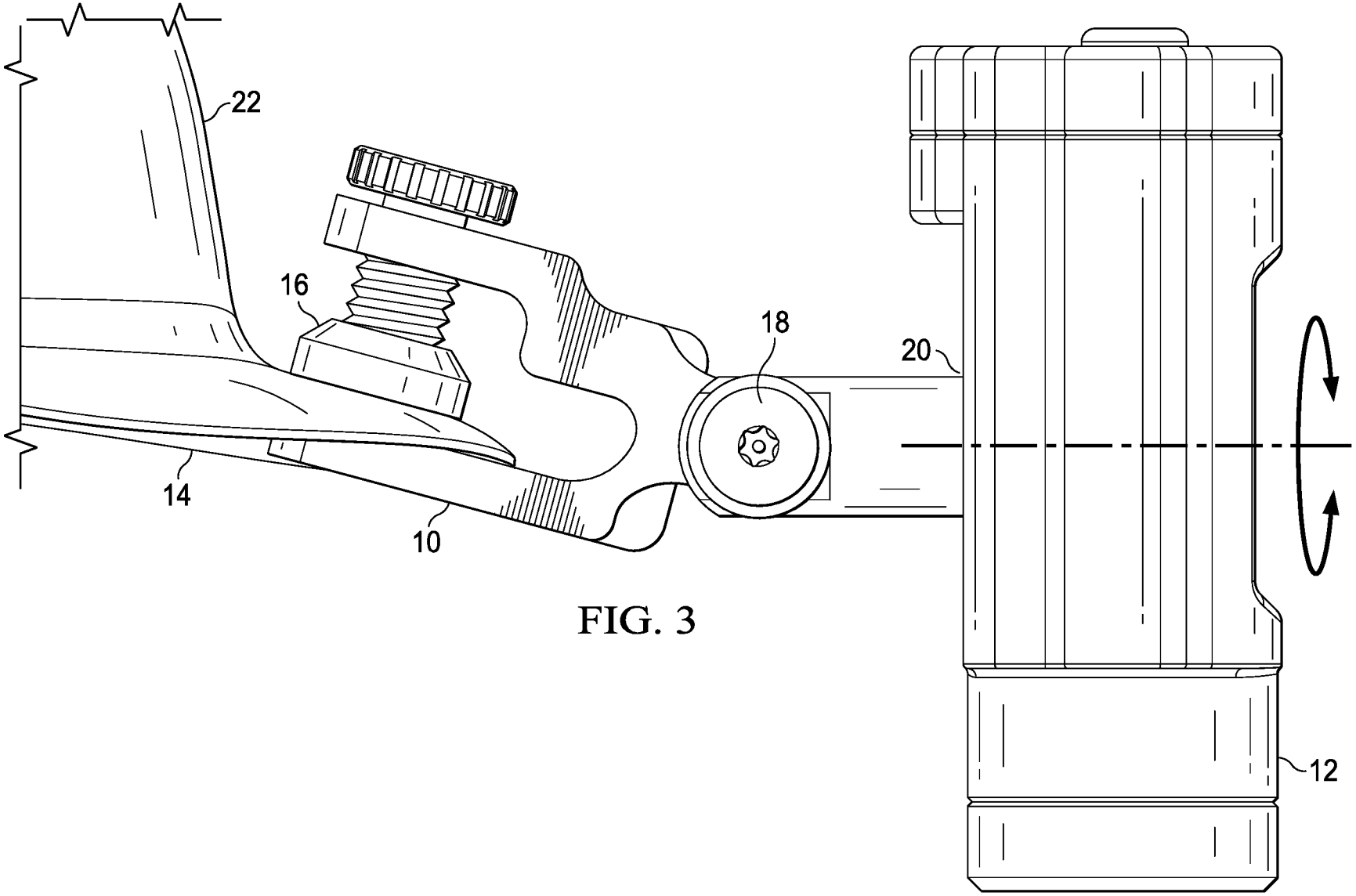
FIG. 3 illustrates the brim mount of FIG. 1, oriented in a third position.

FIG. 1 illustrates a brim mount 10 for a flashlight 12 (alternatively, light 12), oriented in a first position on the brim 14 of a helmet 22, in accordance with an illustrated embodiment of the claimed invention. FIG. 2 illustrates the brim mount 10 of FIG. 1, oriented in a second position. FIG. 3 illustrates the brim mount 10 of FIG. 1, with the flashlight 12 oriented in a third position. In FIGS. 1, 2 and 3 the brim mount 10 includes a clamp 16 to secure the brim mount 10 to the brim 14 of a hat or helmet 22. The brim mount 10 includes a first pivot assembly 18 and a second pivot assembly 20 that also functions to support the flashlight 12 on the brim mount 10. In FIG. 1, the flashlight 12 may rotate in the plane of the figure, i.e., a first plane, through an angle of at least 210° (degrees). In FIG. 2, the light 12 may rotate about the second pivot assembly 20 through an angle of 360° (degrees) in a second plane, i.e., substantially orthogonal to the plane of the figure. In FIG. 3, the light 12 is pivoted within the second plane of the figure at the first pivot assembly 18 and may rotate through an angle of 360° (degrees) in the second plane that is also substantially orthogonal to the axis of the support member 56 of the brim mount 10. As will be described, the adjustment of the orientations depicted in FIGS. 1, 2, and 3 may be made by hand without tools. The rotation of the flashlight 12 is indicated by the bold, curved arrows in FIGS. 1, 2 and 3.

Figure 4:
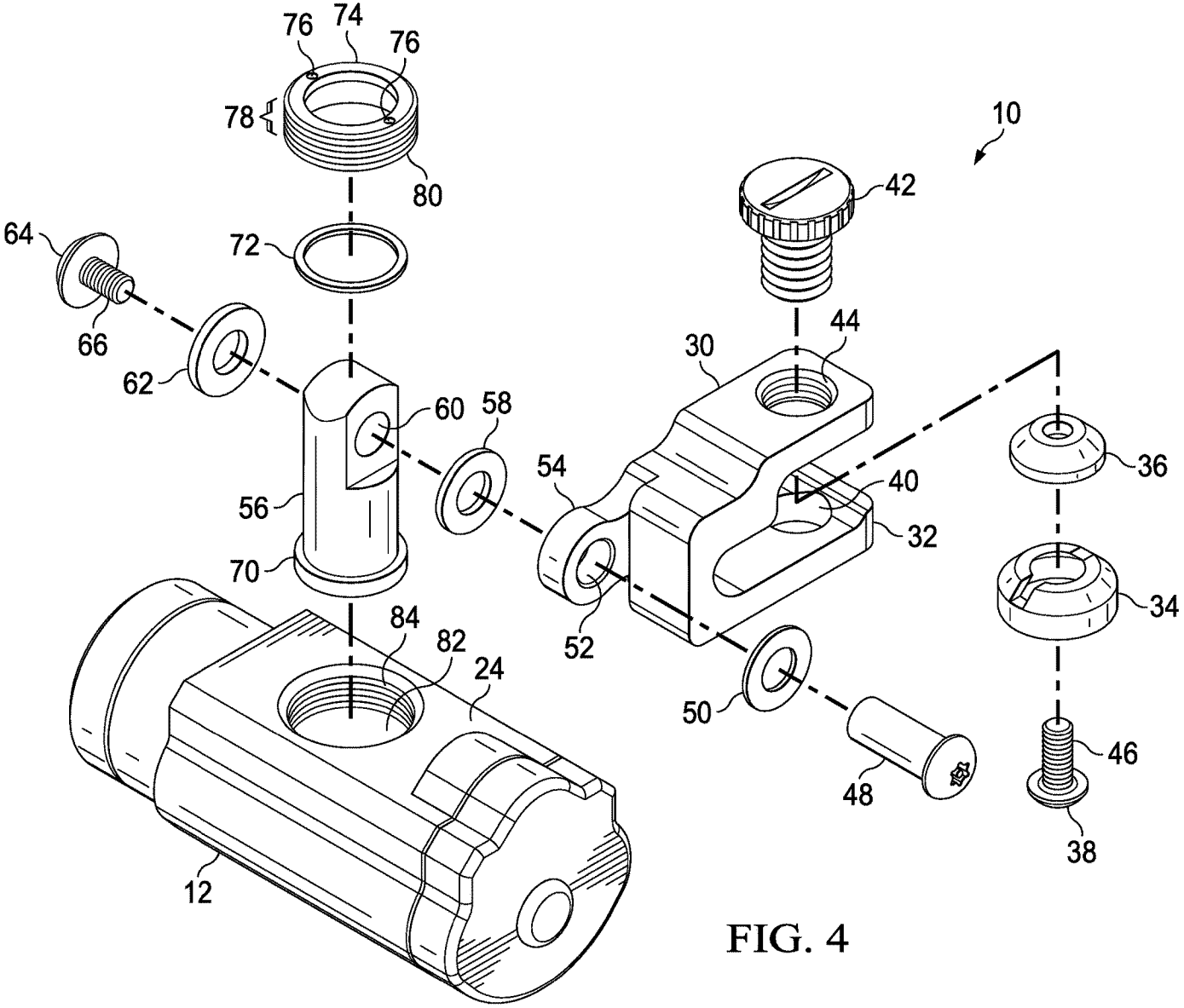
FIG. 4 is an exploded, isometric view of the embodiment of the present invention depicted in FIGS. 1, 2 and 3.

FIG. 4 is an exploded, isometric view of the embodiment of the brim mount 10 depicted in FIGS. 1, 2 and 3. The brim mount 10 includes a clamp body 30 and a support member 56 that is attached to the clamp body 30 via a first pivot assembly 18 formed of the components 48 through 66. The clamp body 30 includes a fixed jaw 32 and a movable clamp pad 34 that may be held against a foot 36 by a clamp screw 38 that is passed through a hole 40 and threads into a thumb screw 42. The thumb screw 42 may be rotated into and within a threaded hole 44 to allow the clamp pad 34 to be tightened or loosened against the brim 14 of a helmet or hat 22. A thread locking adhesive 46 may be added to the threads of the clamp screw 38 to secure the foot 36 and the clamp pad 34 in the clamp body 30.

The first pivot assembly 18 (See FIGS. 1, 2 and 3) may include a barrel nut 48 threaded inserted through a first outside washer 50, a pivot aperture (bushing) 52 in a pivot arm 54, a first wear washer 58, a second pivot aperture (or bushing) 60 in the support member 56, a second outside washer 62, and a pivot lock screw 64 that may be coated with a thread locking adhesive 66. The pivot lock screw 64 coated with the thread locking adhesive 66 is inserted through the parts of the first pivot assembly 18 including the second pivot aperture 62 into the barrel nut 48 and tightened so that sufficient friction in the first pivot assembly is applied to the support member 56 to retain the adjusted position of the lighting device 12 attached to the support member 56. The first pivot assembly 18 enables the mounted light 12 to pivot through an angle of up to 210 degrees within the first plane. This angle, in some cases, may depend on the dimensions of the light 12 that is connected to the brim mount 10. The first wear washer 58 may be made of a relatively soft metal such as brass that is susceptible to some wear so that the first pivot assembly 18 may be adjusted to a predetermined specification by tightening the pivot lock screw 64 into the barrel nut 48.

The second pivot assembly 20 (See FIGS. 1, 2, and 3) is provided by the support member 56 with its flange 70, a second wear washer 72, and a retainer 74. The retainer 74 includes external threads 78 and may include a small hole 76 on each side of the retainer 74 to permit use of a spanner wrench for tightening the retainer 74 within a threaded opening or docking well 82 having internal threads 84 in the docking well formed in the body 24 of the mounted flashlight 12 of FIGS. 1, 2, and 3. The threaded retainer 74 may be threaded into the threaded opening or docking well 82 and tightened so that sufficient friction in the second pivot assembly 20 is applied to support the mounted flashlight 12 in the adjusted angular position. The retainer 74 may also be secured using a thread locker adhesive 80 applied to the external threads 78 of the retainer 74 or the internal threads 84 of the threaded opening or docking well 82. The flange 70 at the lower end of the support member 56 is adapted to fit within the threaded opening or docking well 82 formed into the body 24 of the mounted flashlight 12 to be connected to the brim 14. The second pivot assembly 20 also enables the mounted light 12 to be pivoted through an angle of 360 degrees within the second plane to adjust the orientation of the flashlight 12. The second wear washer 72 may be made of a relatively soft metal such as brass that is susceptible to some wear so that the second pivot assembly 20 may be adjusted to a predetermined specification by tightening the threaded retainer 74 into the threaded opening or docking well 82.

Accordingly, the brim mount 10 provides an adjustable mounting fixture formed like a clevis configured as a clamp or vise having a fixed jaw and a movable jaw or foot coupled to an adjustment bolt in one prong of the clamp for securing the brim mount 10 and its attached helmet light 12 to the brim 14 of the helmet 22, without the use of tools. In use, the first pivot 18 may be configured with a binding barrel design that applies sufficient friction to adjust and hold the mounted light 12 in a set position by hand while enabling the mounted light 12 to pivot through 210 degrees within a first plane without the use of tools. The second pivot 20, may also be configured with a binding retainer design that applies sufficient friction to adjust and hold the mounted light 12 in a set position by hand while enabling the mounted light 12 to pivot through 360 degrees within a second plane substantially orthogonal to the first plane without the use of tools.

While the illustrated embodiment has been shown in one of its forms to depict the concepts of the invention, it is not thus limited but is susceptible to various changes and modifications without departing from the spirit of the invention as set forth in the claims appended hereto. For example, while the illustrated embodiment depicts a flashlight for use with the brim mount, any other type of battery-operated lighting device that is compact and can be configured with a docking well is contemplated herein. The brim mount 10 may be constructed of a variety of metals or engineered plastics, for example. The movable clamp pad 34 may be formed of a non-skid rubber or other resilient synthetic material. The first and second wear washers may be made of alternate materials suitable for the intended purpose. The first and second wear washers may also be replaced by new components to restore full operation to the first and second pivot assemblies.

What is claimed is:

1. Apparatus for supporting a light on a helmet brim, comprising:

a U-shaped clamp body formed as a vise for securing to the helmet brim, wherein a flattened pivot arm having a first bushing aperture extends opposite an open end of the U-shaped clamp body;

a support member having first and second ends, the first end configured with a second bushing aperture and the second end configured with a circumferential flange having a diameter to be received in an internally threaded docking well formed in a light housing;

a binding barrel pivot assembly disposed through the first and second bushing apertures to form a first pivot and enable the support member to pivot in a first plane through at least 180 degrees about the first pivot; and an externally threaded binding retainer disposed around the support member adjacent the circumferential flange to secure the support member into the docking well thereby forming a second pivot to enable the light housing to pivot 360 degrees in a second plane orthogonal to the first plane.

2. The apparatus of claim 1, wherein:

The first and second pivots are independently adjustable without the use of tools to adjust the orientation of the light housing.

3. The apparatus of claim 1, wherein the U-shaped clamp body comprises:

a first prong of the open end of the U-shaped clamp body configured as a fixed jaw of a clamp;

a second prong of the open end of the U-shaped clamp body configured with a bolt threaded there through; and a movable foot attached to a threaded end of the bolt and disposed opposite the fixed jaw, to enable securing the U-shaped clamp body on the helmet brim.

4. The apparatus of claim 1, wherein the support member comprises:

a cylindrical member configured at the first end with a flattened tab having the second bushing aperture to be disposed against the flattened pivot arm having the first bushing aperture.

5. The apparatus of claim 1, wherein the binding barrel pivot assembly comprises:

a sleeve nut configured as a pivot shaft that forms the first pivot when joined with the first and second bushing apertures;

first and second outside washers, one on either side of the first end of the support member;

a wear washer disposed next to a second outside washer; and a binding screw threaded into the sleeve nut for securing the binding barrel pivot assembly.

6. The apparatus of claim 1, wherein the binding retainer comprises:

a retaining ring having an external thread for mating with internal threads formed in the docking well of the housing to secure the circumferential flange of the support member in the docking well of the light housing.

7. Apparatus, comprising:

a flashlight having a housing, a light source and a battery to power the light source enclosed in the housing, and an internally threaded opening in one side of the housing;

a clamp formed as a U-shaped body having a fixed jaw and movable clamp pad at an open end of the U-shaped body, and a first pivot assembly disposed at an end of the clamp opposite the open end; and a cylindrical member, pivotally attached at a first end to the first pivot assembly, also having a second pivot assembly at a second end thereof for pivotally supporting the housing of the flashlight from the internally threaded opening in the one side of the housing.

8. The apparatus of claim 7, wherein:

the clamp and the cylindrical member, pivotably coupled together, form a mounting fixture to adjustably support the flashlight on a brim of a helmet through orthogonal first and second angles.

9. The apparatus of claim 8, wherein:

the flashlight is enabled to pivot about the first pivot assembly with respect to the mounting fixture through the first angle of at least 180 degrees within a first plane and to pivot about the second pivot assembly through the second angle of 360 degrees within a second plane orthogonal to the first plane.

10. The apparatus of claim 9, wherein:

the first and second angles are independently adjustable by hand without the use of tools.

11. The apparatus of claim 7, wherein:

the fixed and movable jaw pair of the clamp is configured to adjustably secure the flashlight to a brim of a helmet.

* * * * *